United States Patent [19]

Lambot

[11] 4,300,643

[45] Nov. 17, 1981

[54] DOUBLE CORE BARREL

[75] Inventor: Honore J. Lambot, Wauthier-Braine, Belgium

[73] Assignee: Diamant Boart, Brussels, Belgium

[21] Appl. No.: 129,948

[22] Filed: Mar. 13, 1980

[30] Foreign Application Priority Data

Mar. 22, 1979 [BE] Belgium ..... 194149

[51] Int. Cl.[3] ..... E21B 9/20; E21B 25/00

[52] U.S. Cl. ..... 175/244

[58] Field of Search ..... 175/244, 246

[56] References Cited

U.S. PATENT DOCUMENTS

| | | | |
|---|---|---|---|
| 997,358 | 7/1911 | Ameling | 175/244 |
| 2,189,057 | 2/1940 | Copelin | 175/246 |
| 2,357,907 | 9/1944 | Phillips | 175/244 |
| 2,621,897 | 12/1952 | Brown | 175/246 |
| 3,215,210 | 11/1965 | Dickinson | 175/244 |
| 3,504,750 | 4/1970 | Tiraspolsky et al | 175/244 |
| 3,986,555 | 10/1976 | Robertson | 175/246 |

*Primary Examiner*—James A. Leppink

*Attorney, Agent, or Firm*—Sughrue, Mion, Zinn, Macpeak and Seas

[57] ABSTRACT

A double core barrel for carrying out boring and arc drilling in oilfields comprises a rotary outer tube 1 with a boring bit 3 and a non-rotary inner tube 2, with an extractor cone 9, screwed onto the lower non-rotary portion of a pivoting means 11 whose upper rotary position 12 is screwed into a tapped body 4 of the outer tube 1. The upper end 15 of the portion 12 cooperates with an adjustment spanner 16 which transmits a rotation couple to the upper end, to allow adjustment of the spacing for the passage of water between the bit 3 and the cone 9. The upper end 15 has an external longitudinal groove, while the tapped body has a slot 8 at the base of a smooth cylindrical bore 6 and at the level of the longitudinal groove 17. The upper end 15 receives a locking cap 18 having a lower catch 20 and being designed to cooperate with an adjustment spanner 16 to transmit a rotation couple to the catch 20 and being designed to slide between the upper end 15 and the bore 6 so that the catch 20 may first be engaged in the groove 17 and then simultaneously in this groove 17 and in the slot 8 so that the cap 18 then locks the portion 12 and the body 4 to prevent their relative rotation.

5 Claims, 11 Drawing Figures

DOUBLE CORE BARREL

BACKGROUND OF THE INVENTION

The present invention relates to a double core barrel for carrying out boring and core drilling operations, e.g. in oilfields, and to a method of adjusting the spacing between a boring bit and an extractor cone in the core barrel.

The double core barrel basically comprises a rotating external tube and a fixed internal tube. The lower end of the external tube is provided with a boring bit. The lower end of the internal tube is provided with an extractor cone. The upper end of the inner tube is screwed onto the lower, non-rotary portion of pivoting means enabling mechanical connection between the inner tube and the outer tube. The upper rotary portion of the pivoting means is screwed into a screw-threaded body which is part of the outer tube. The upper portion of the pivoting means therefore rotates in conjunction with the outer tube.

THE PRIOR ART

In known double core barrels of this type, the lower, non-rotary portion of the pivoting means comprises, on one hand, a lower tubular element onto which the upper end of the inner tube is screwed and, on the other hand, an upper tubular element screwed coaxially into the upper end, which is screw-threaded, of the previous element. Thus the two tubular elements define between each other, along their common external surface, an annular groove for housing a ball thrust-bearing. On the other hand, the upper rotary portion of the pivoting means comprises, on one hand, an upper sleeve whose upper end is threaded and whose lower end is tapped and, on the other hand, a threaded ring screwed coaxially into the sleeve. The ring and the sleeve define between each other, along their common internal surface, an annular groove opposite to the above annular groove and also for housing a ball thrust-bearing.

The known double core barrels have the intrinsic disadvantages of slow, difficult, and costly regulation of the spacing for the passage of water between the lower ends of the boring bit and the extractor cone.

In effect, in order to regulate the above spacing in a known double core barrel, the inner tube and its pivoting means are firstly mounted in the external tube with its boring bit removed. After these have been mounted, the length of the extractor cone which exceeds the lower end of the external tube is measured and, more precisely, the length then separating the lower edge of this end from the upper edge of the most extreme bevel of the extractor cone. This temporary projecting length is compared with the distance which should, in practice, separate the lower edge of the external tube from the upper edge of the bevel of the extractor cone. It is thus possible to ascertain at this time the temporary spacing between the lower ends of the boring bit and the extractor cone, this temporary spacing resulting from the difference between the separation distance to be obtained and the length of projection measured and being greater than the spacing to be obtained. The inner tube and the pivoting means are then dismounted from the outer tube. After this, annular inserts of suitable thicknesses are placed against one edge of the threaded bore of the body of the external tube, the upper sleeve of the rotary portion of the pivoting means being screwed into this body, the total thickness of the said inserts being such that the above-mentioned temporary spacing is adjusted to a correct value. After positioning of the adjustment inserts, the pivoting means and the inner tube are mounted in the outer tube which is then provided with its boring bit. In this way it is possible to obtain a substantially normal spacing between the boring bit and the extractor cone.

Adjusting the spacing between the boring bit and the extractor cone by means of inserts requires assembly, disassembly, and complete re-assembly of the inner tube and the pivoting means in respect of the outer tube. Adjustment of this type is therefore difficult of necessity and normally takes from 1 to 2 hours. In addition the use of inserts of predetermined thicknesses does not enable the above-mentioned spacing to be obtained accurately.

SUMMARY OF THE INVENTION

The invention relates to a new double core barrel which remedies the above drawbacks of the known core barrels and which enables, in particular, adjustment of the above-mentioned spacing in a few minutes and does not complicate the assembly of the inner tube and the pivoting means in the outer tube.

For this purpose the invention provides a double core barrel in which the upper end of the rotary portion of the pivoting means is adapted to cooperate with an adjustment spanner which transmits to the rotary portion a rotary couple about its longitudinal axis. In addition, the upper end of the rotary portion of the pivoting means has at least one longitudinal groove externally. Moreover, the tapped body of the outer tube has at least one slot at the base of a smooth cylindrical bore and at the level of the longitudinal groove of the upper end of the rotary portion of the pivoting means. Finally, the upper end of the rotary portion of the pivoting means may be provided with a locking cap having at least one lower catch. The cap is adapted to cooperate with an adjustment spanner (preferably identical to the above spanner) which may transmit to the cap a rotary couple about its longitudinal axis. The cap is also designed to be able to slide between the upper end of the rotary portion of the pivoting means and the smooth cylindrical bore of the tapped body of the outer tube in such a way that the catch may be engaged, in the first instance, in the longitudinal groove of the said upper end and then simultaneously in this same longitudinal groove and in the slot at the base of this smooth cylindrical bore. In this way, the cap then angularly locks the upper rotary portion of the pivoting means and the tapped body of the outer tube in order to prevent their relative rotation about their common vertical axis.

In practice the upper end of the rotary portion of the pivoting means preferably has at least two longitudinal grooves which are diametrically opposite, the tapped body of the outer tube has at least two diametrically opposite slots, and the cap is provided with at least two diametrically opposite catches.

In order to limit the rotation of the cap after adjustment of the spacing between the boring bit and the extractor cone and during the mutual angular locking of the upper rotary portion of the pivoting means and the tapped body of the outer tube of this novel double core barrel, the tapped body has four uniformly distributed slots about its longitudinal axis at the base of its smooth cylindrical bore.

BRIEF DESCRIPTION OF THE DRAWINGS

The invention will be described further, by way of example, with reference to the accompanying drawings, in which.

DESCRIPTION OF THE PREFERRED EMBODIMENT

Figure 1:
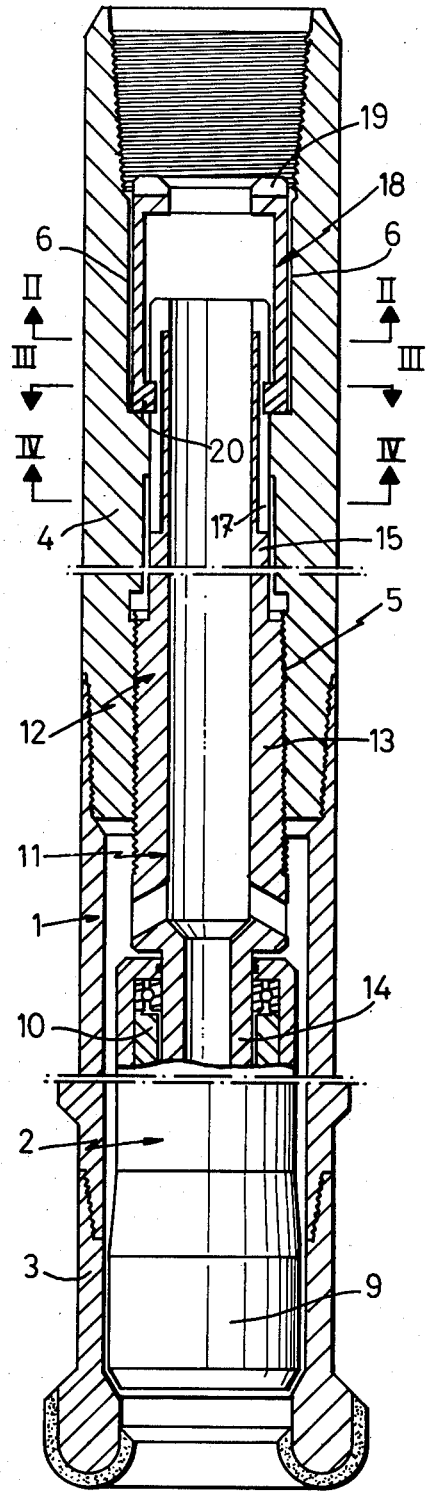
FIG. 1 is a longitudinal section through a double core barrel.
Figure 2:
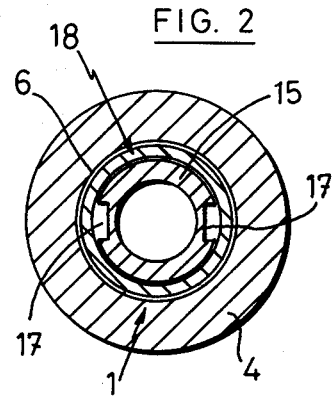
FIGS. 2, 3, and 4 are sections along the lines II—II, III—III, and IV—IV, respectively, of FIG. 1.
Figure 3:
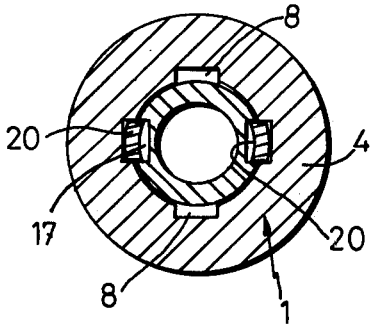
Figure 4:
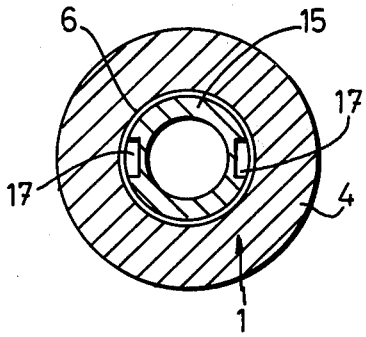
Figure 5:
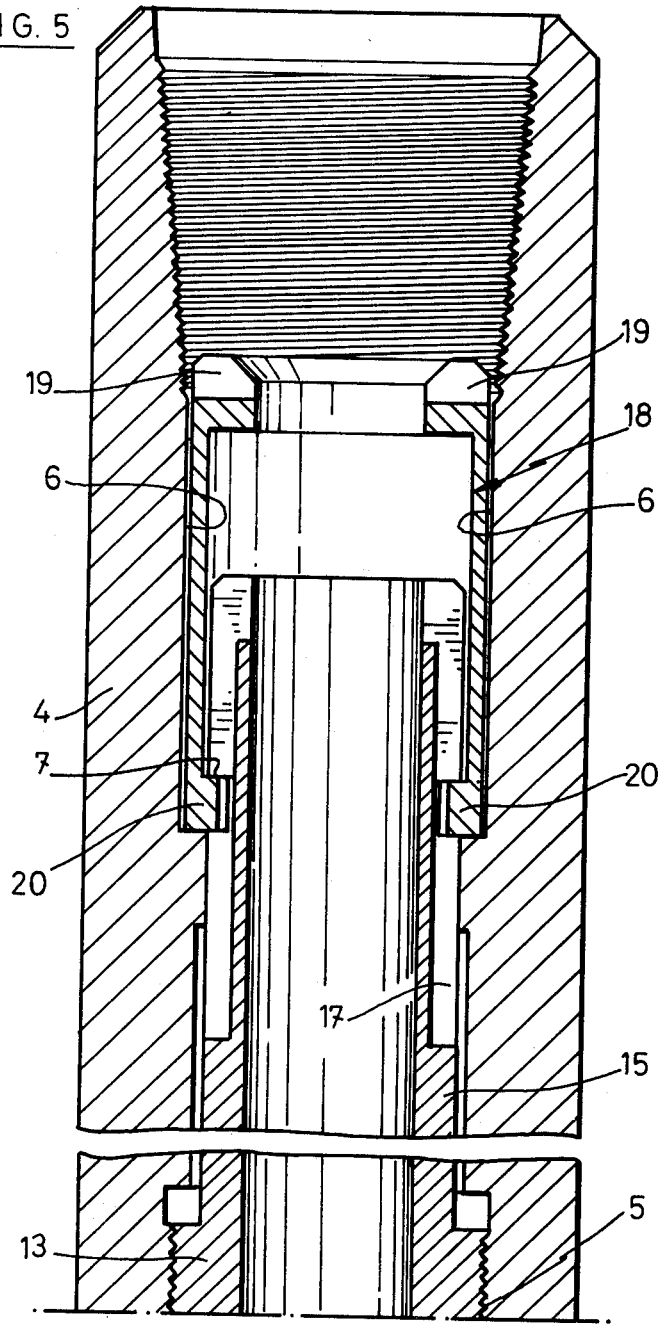
FIG. 5 is a longitudinal section of the double core barrel on an enlarged scale.

The double core barrel illustrated is used for boring and core sampling operations in oilfields. It comprises an outer tube 1 and an inner tube 2.

The outer tube 1 is constituted by a sequence of tubular elements screwed successively to one another. The lower tubular element supports a boring bit 3 provided with a diamond tip. The upper tubular element is formed by a body 4 having a tapered bore 5 in its lower portion and a smooth cylindrical bore 6 in its upper portion. The smooth bore 6 is confined at the bottom by a base formed by an annular flange 7 having at least one slot 8; in this case, four slots 8 are distributed uniformly about the longitudinal axis of the body 4.

The inner tube 2 comprises rigidly connected tubular elements disposed coaxially to the outer tube 1. The lower tubular element supports a core extractor cone 9. The upper tubular element is screwed to the lower non-rotary portion 10 of a pivoting means 11. In effect, the pivoting means 11 serves to mount the inner tube 2 in the outer tube 1.

In a manner known per se, the lower portion 10 of the pivoting means 11 comprises a sleeve whose body is extended at the base by a hollow axial rod of smaller diameter. The upper portion of the body of the sleeve is tapped and receives a nut which forms an annular housing for thrust bearings and ball bearings. The lower end of the hollow rod supports an external flange supporting superposed spring washers. These washers resiliently urge an annular support, which is threaded, against the body of the sleeve. The upper, tapped end of the upper tubular element of the inner tube 2 is screwed onto this annular support. In this way, the lower portion 10 of the pivoting means 11 is connected mechanically and axially to the inner tube 2.

The upper portion 12 of the pivoting means 11 comprises a single tubular element screw-threaded on its broadest median portion 13. This median portion 13 is screwed into the tapped bore 5 of the body 4. The lower, narrowest portion 14 of this tubular element is adapted to wedge the above-mentioned thrust and ball bearings.

Figures 6, 7, 8, 9, 10:
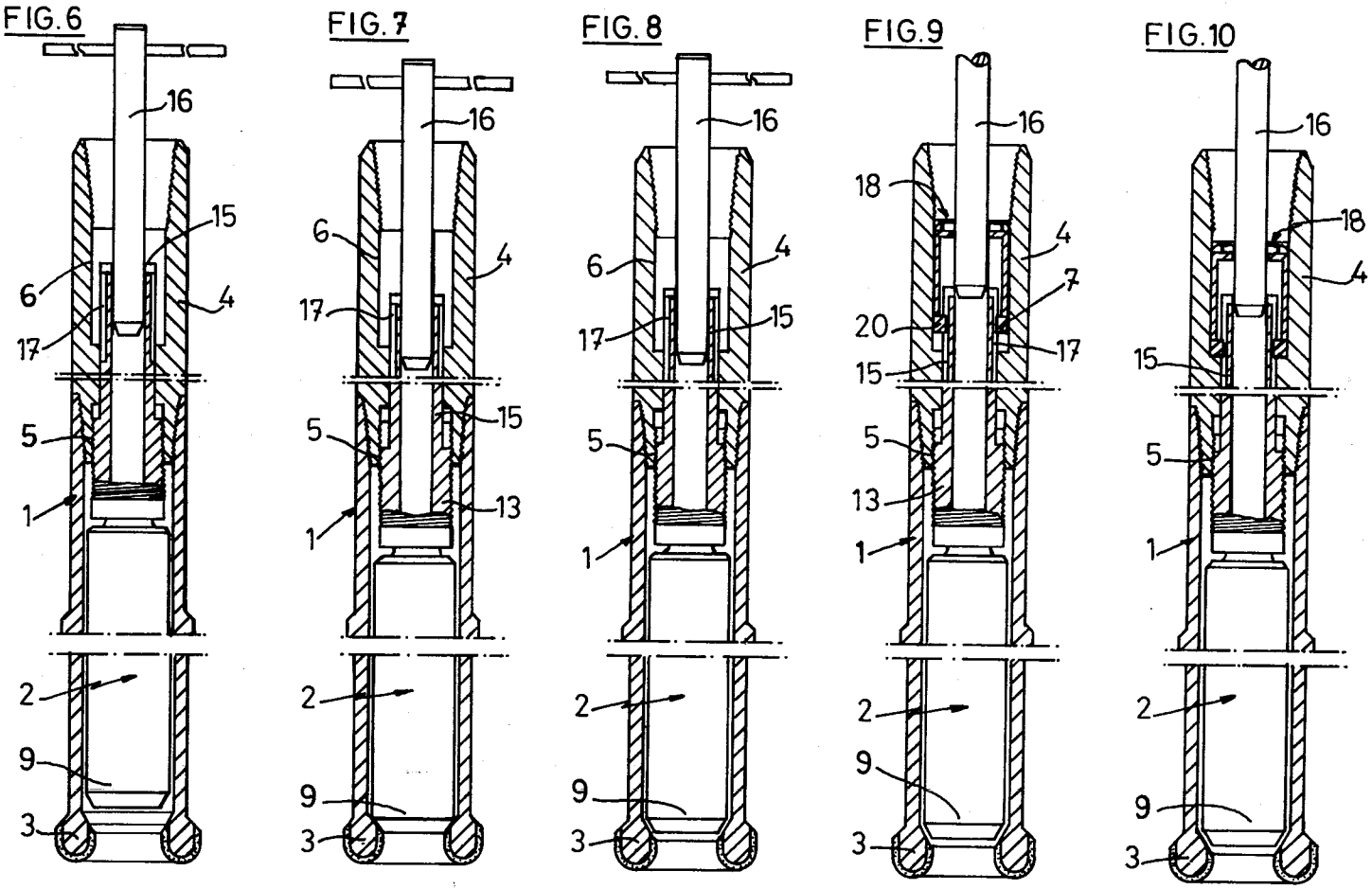
FIGS. 6, 7, 8, 9, and 10 are diagrams of the core barrel illustrating its method of adjustment.
Figure 11:
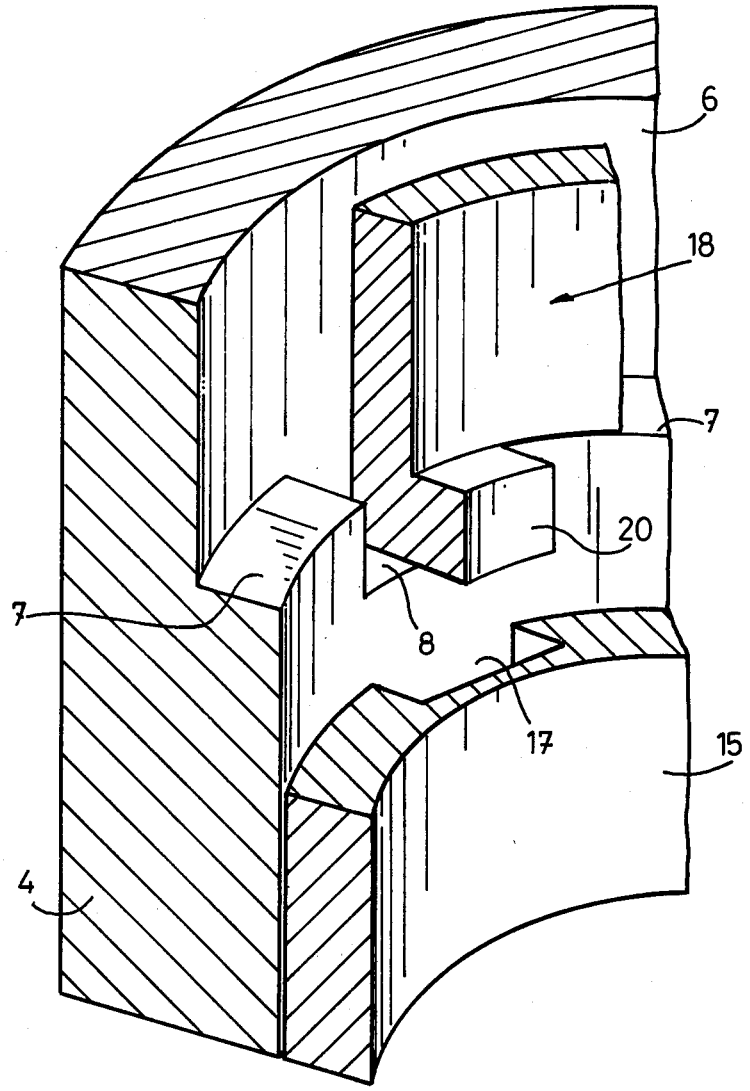
FIG. 11 is a sectioned perspective view on an enlarged scale, showing the operation of the locking cap of the core barrel.

The upper end 15 of the upper portion 12 of the pivoting means 11 is designed to receive the lateral catches of an adjustment spanner 16 and thus to cooperate with the spanner 16 (FIGS. 6 to 8). By means of this spanner 16, a rotation couple may be transmitted to this upper end 15 about its longitudinal axis, which also coincides, after assembly, with the common longitudinal axis of the inner tube 1 and the outer tube 2. In addition, the upper end 15 has on its external surface at least one longitudinal groove 17, preferably at least two diametrically opposite longitudinal grooves 17 as shown. During assembly of the core barrel, the upper end 15 passes within the smooth cylindrical bore 6 of the tapped body 4 in such a way that, after assembly, the above-mentioned slots 8 are located at the level of the longitudinal grooves 17.

The upper end 15 of the upper portion 12 of the pivoting means 11 may receive a cap 18 having two diametrically opposite grooves 19 at its upper end and provided with at least one catch 20, preferably two diametrically opposite catches 20 as shown, on its lower peripheral edge. The catches 20 project downwardly at the base. The external diameter of the cap 18 is slightly smaller than that of the smooth cylindrical bore 6 of the tapped body 14. The internal diameter of the cap 18 is slightly greater than the external diameter of the above-mentioned upper end 15. In this way, when the catches 20 are at the top of the longitudinal groove 17, the cap 18 may slide downwardly in the smooth bore 6, between the upper end 15 and the tapped body 4, until the catches 20 contact the base of the bore 6, i.e. contact the annular flange 7. In addition when the catches 20 are opposite the slots 8 they may penetrate into these slots 8 whilst remaining in the longitudinal grooves 17. In this latter position, the cap urged downwardly to the base ensures the mechanical connection between the upper end 15 and the tapped body 4 by locking them angularly and by preventing their relative rotation about their common longitudinal axis. The cap 18 is therefore a means for mutually locking the upper end 15 and the tapped body 4 about the longitudinal axis of the core barrel.

In operation, the outer tube 1 rotates about its longitudinal axis to cause the boring bit 3 to operate. During operation the cap 18 is mounted at the base of the upper end 15, which causes the simultaneous rotation of the outer tube 1 and the upper portion 12 of the pivoting means 11. However, by means of the thrust bearings and ball bearings with which the pivoting means 11 is provided, the lower portion 10 of the pivoting means 11 does not rotate about the longitudinal axis of the apparatus in the same way as the inner tube 2.

The assembly of the double core barrel described above is carried out as follows, with the outer tube 1 disposed vertically.

The complete pivoting means 11 is first screwed into the tapped body 4 of the outer tube 1. The inner tube 2, provided with the extractor cone 9, is then screwed onto the lower portion 10 of the pivoting means 11. The remaining portion of the outer tube 1 is then screwed onto the tapped body 4. The boring bit 3 is finally screwed onto the lower end of the otuer tube 1. The core barrel is then assembled (FIG. 6).

The adjustment of the spacing between the lower ends of the extractor cone 9 and the boring bit 3 is carried out as follows, with the outer tube 1 disposed vertically.

The cap 18 is first checked to ensure that it is not in contact with the upper rotary portion 12 of the pivoting means 11 and if it is defective in this way it is removed.

The upper rotary portion 12 of the pivoting means 11 is then screwed downwardly into the tapped bore 5 of the body 4 and in this way the lower non-rotary portion 10 of the pivoting means 11 and the inner tube 2 are displaced axially downwardly. This operation is continued until the lower end of the extractor cone 4 abuts against the lower end of the boring bit 3 (FIG. 7).

The upper rotary portion 12 of the pivoting means 11 is then unscrewed upwardly in the tapped bore 5 of the body 4 and in this way the lower non-rotary portion 10 of the pivoting means 11 and the inner tube 2 are moved axially upwardly. This unscrewing operation is carried out in accordance with an angle of rotation which is determined by the pitch of the thread of the tapped bore 5 and by the normal spacing to be achieved between the lower ends of the extractor cone 4 and the boring bit 3. In this way the lower end of the extractor cone 4 is positioned at the required distance (2 to 4 mm as required) from the lower end of the boring bit (FIG. 8).

After the above adjustment of the spacing between the lower ends of the extractor cone 4 and the boring bit 3, the upper rotary portion 12 of the pivoting means 11 is locked in respect of the tapped body 4 in order to ensure the simultaneous rotation of the portion 12 and the outer tube 1. The following procedure is carried out for this purpose.

The locking cap 18 is positioned on the upper end 15 of the upper rotary portion 12 of the pivoting means 11 and is slightly rotated about its axis, by means of the spanner 16, until the catches 20 engage in the longitudinal grooves 17 of this upper end 15.

The cap 18 is then caused to slide downwardly in the smooth cylindrical bore 6 of the tapped body 5 along the above-mentioned upper end 15, until the catches 20 abut against the annular flange 7 confining the smooth cylindrical bore 6 at its base (FIG. 9).

The cap 18 is then slightly rotated and therefore the upper rotary portion 12 of the pivoting means 11 about their common axis, by means of the spanner 16, until the catches engage in two diametrically opposite slots 8 opposite to the annular flange 7 (FIG. 10).

In this way the upper rotary portion 12 of the pivoting means 11 and the tapped body 4 of the outer tube 1 are angularly locked.

It is obvious that the invention is not exclusively limited to the embodiment illustrated and that many modifications may be made to the shape, the arrangement, and the constitution of certain of the elements used in the embodiment with the proviso that these modifications do not exceed the scope of the following claims.

What is claimed is:

1. A double core barrel comprising:

a rotary outer tube, a tapped body provided in the upper portion of the outer tube, a boring bit mounted on the lower end of the outer tube, a non-rotary inner tube, an extractor cone arranged on the lower end of the inner tube, a pivoting means connected with the inner tube whereby the lower non rotary portion of said pivoting means is screwed with respect to the upper end of said inner tube whilst the upper rotary portion of said pivoting means is screwed into the tapped body of the outer tube in order to rotate in conjunction with this latter, the upper end of the upper rotary portion of said pivoting means being designed to be able to cooperate with an adjustment spanner which transmits a rotation couple to the upper end about its longitudinal axis, at least one longitudinal groove externally provided in the upper end of the upper rotary portion of the pivoting means, at least one slot at the base of a smooth cylindrical bore provided in the tapped body of the outer tube whereby said slot is located at the level of the longitudinal groove of the upper end of the upper rotary portion of the pivoting means, a locking cap which may be carried by the upper end of the upper rotary portion of the pivoting means, said locking cap having at least one lower catch, said locking cap being designed on the one hand, to be able to cooperate with an adjustment spanner preferably identical to the previous spanner and able to transmit a rotation couple to the catch about its longitudinal axis and, on the other hand, to be able to slide between said upper end and the smooth cylindrical bore of the tapped body in such a way that the catch may be firstly engaged in the longitudinal groove of the said upper end and then simultaneously in this same longitudinal groove and in the slot at the base of this smooth cylindrical bore in such a way that the cap then locks in an angular manner the upper rotary portion of the pivoting means and the tapped body of the outer tube in order to prevent their relative rotation about their common vertical axis.

2. A core barrel as claimed in claim 1, wherein the upper end of the rotary portion of the pivoting means has at least two diametrically opposite longitudinal grooves, whilst the tapped body of the outer tube has at least two diametrically opposite slots and whilst the locking cap is provided with at least two diametrically opposite catches.

3. A core barrel as claimed in claim 2, wherein the tapped body of the outer tube has four slots distributed uniformly about its longitudinal axis, at the base of its smooth cylindrical bore.

4. A method for adjusting the spacing for the passage of water between the lower ends of a boring bit and an extractor cone of a core barrel having an inner tube and pivoting means disposed in a vertically oriented outer tube, comprising the steps of:

removing a locking cap from an upper rotary portion of the pivoting means, screwing the upper rotary portion of the pivoting means downwardly into a tapped body of the outer tube with an adjustment spanner to displace a lower non-rotary portion of the pivoting means and the inner tube axially downwardly in the outer tube until the lower end of the extractor cone abuts against that of the boring bit, unscrewing the upper rotary portion of the pivoting means upwardly in the tapped body of the outer tube with the adjustment spanner to displace the lower non-rotary portion of the pivoting means and the inner tube axially upwardly in the outer tube, in accordance with an angle of rotation determined by the pitch of the thread of the upper rotary portion and by the normal spacing of the lower ends of the boring bit and the extractor cone, to thereby raise the lower end of the extractor cone by a height equal to said normal spacing, and angularly locking the upper rotary portion of the pivoting means and the tapped body of the outer tube to prevent their relative rotation about their common axis.

5. A method of adjustment as claimed in claim 4, wherein the angular locking comprises the steps of:

positioning the locking cap on the upper end of the upper rotary portion of the pivoting means, rotating the locking cap about its axis with the adjustment spanner until a catch of the cap engages in a longitudinal groove of the upper end, sliding the locking cap downwardly in a smooth cylindrical bore of the tapped body of the outer tube along the upper end of the upper rotary portion of the pivoting means until it abuts against a base of said bore, and rotating the locking cap and the upper rotary portion of the pivoting means about their common axis in the outer tube until the catch of the cap engages in a slot at the base of the smooth cylindrical bore of the tapped body.

* * * * *